US006273714B1

(12) United States Patent
Farzin-Nia et al.

(10) Patent No.: US 6,273,714 B1
(45) **Date of Patent: *Aug. 14, 2001**

(54) DENTAL AND ORTHODONTIC ARTICLES OF REACTIVE METALS

(75) Inventors: Farrokh Farzin-Nia, Inglewood, CA (US); Rohit Chaman Lal Sachdeva, Plano, TX (US)

(73) Assignee: Ormco Corporation, Glendora, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/157,341

(22) Filed: Sep. 18, 1998

Related U.S. Application Data

(63) Continuation of application No. 08/453,910, filed on May 30, 1995, now Pat. No. 5,904,480.

(51) Int. Cl.[7] ..... A61C 3/00
(52) U.S. Cl. ..... 433/20; 420/421; 420/422
(58) Field of Search ..... 433/2, 20, 215; 420/421, 422

(56) References Cited

U.S. PATENT DOCUMENTS

| | | | | |
|---|---|---|---|---|
| 1,965,093 | | 3/1934 | Aderer | 420/464 |
| 3,271,205 | | 9/1966 | Winton et al. | 148/672 |
| 4,040,129 | * | 8/1977 | Steinemann | 3/1.9 |
| 4,197,643 | * | 4/1980 | Burstone et al. | 433/20 |
| 4,253,933 | | 3/1981 | Sat et al. | 420/417 |
| 4,490,112 | | 12/1984 | Tanaka et al. | 433/20 |
| 5,044,947 | | 9/1991 | Sachdeva et al. | 433/20 |
| 5,108,523 | | 4/1992 | Peterseim et al. | 148/402 |
| 5,137,446 | | 8/1992 | Yamauchi et al. | 433/20 |
| 5,169,597 | * | 12/1992 | Davidson et al. . | |
| 5,232,361 | * | 8/1993 | Sachdeva et al. | 433/8 |
| 5,380,200 | * | 1/1995 | Heath et al. | 433/102 |
| 5,383,784 | * | 1/1995 | Sernetz | 433/7 |
| 5,399,088 | | 3/1995 | Mechley | 433/20 |
| 5,429,501 | * | 7/1995 | Farzin-Nia et al. | 433/21 |
| 5,509,993 | * | 4/1996 | Hirschvogel | 156/326 |
| 5,513,793 | * | 5/1996 | Malmgren | 228/193 |
| 5,573,401 | * | 11/1996 | Davidson et al. | 433/8 |
| 5,670,726 | * | 9/1997 | Kolaska et al. | 75/237 |
| 5,692,899 | * | 12/1997 | Takahashi et al. | 433/20 |
| 5,724,643 | * | 3/1998 | Ewing | 419/8 |
| 5,904,480 | * | 5/1999 | Farzin-Nia et al. | 433/20 |

FOREIGN PATENT DOCUMENTS

| | | |
|---|---|---|
| 788245 | 12/1957 | (GB) . |
| 9534251 | 6/1995 | (WO) . |

* cited by examiner

*Primary Examiner*—Ralph A. Lewis
(74) *Attorney, Agent, or Firm*—Wood, Herron & Evans, L.L.P.

(57) ABSTRACT

Dental and orthodontic articles comprising alloys of a material selected from the group consisting of T, Zr, Si, Mo, Co, Nb and Be. The alloys may further include at least one secondary alloying element selected from the group consisting of Ta, Cr, Al, V, Pd, Hf and Fe. The alloys preferably comprise a primary constituent in the range of about 30–85% by weight of the alloy, a secondary alloying component in the range of about 0.5–10% by weight, and the alloy has a modulus of elasticity in the range of about 5 million to 15 million psi.

8 Claims, No Drawings

DENTAL AND ORTHODONTIC ARTICLES OF REACTIVE METALS

This is a continuation of Ser. No. 08/453,910 filed May 30, 1995, now U.S. Pat. No. 5,904,480.

FIELD OF THE INVENTION

The present invention is directed to dental and orthodontic articles, and more particularly to such articles made from alloys of reactive metals.

BACKGROUND OF THE INVENTION

Traditionally, systems used for the orthodontic movement of teeth consist of an archwire that is deformed and bent into a shape so as to provide a load or force on one or more orthodontic brackets attached to the patient's teeth to move the teeth in a predetermined direction. Various materials and alloys are known for use in such orthodontic archwires, as well as for the brackets themselves. These known materials include stainless steels, shape memory and/or superelastic nickel titanium alloys, ceramics, and materials with organic and metallic components, among others, all of which have vastly differing properties. The specific material selected depends on the orthodontic purpose for which the device is to be used. The most widely used materials, based on their functionality as opposed to their aesthetic properties, are metallic alloys. Within the realm of available alloys, the selection of a particular alloy for use in an orthodontic or dental treatment is influenced by a variety of factors, including: (1) the wire strength and stiffness, which determine the amount of forces available for tooth movement; (2) the working range of the wire, which determines the amount of tooth movement that can be obtained before the wire comes to rest in a deformed state; (3) the ease with which the wire can be bent and manipulated; and (4) other physical and mechanical characteristics of the wire, such as transformation temperature, etc.

In addition to the foregoing parameters, it must be borne in mind that orthodontic treatments are generally accomplished in several stages, each of which may require a different type of wire or a wire possessing different properties. In the initial stage of treatment, leveling and alignment of the teeth takes place. In this stage, highly flexible wires are required which exert low forces over long working ranges. Suitable alloys for such archwires are NiTi-based alloys. In the intermediate stage of treatment, leveling and alignment of the arches are generally completed and minor adjustments in the tooth relationships, as well as the overall arch relationship must be addressed. At this stage of treatment, wire properties and characteristics required include high stiffness, moderate working ranges, relatively easy bendability and low coefficient of friction. Beta III titanium alloys and stainless steels are frequently used. These wires, however, do not typically possess all the desired properties and characteristics, although they are currently some of the most suitable materials that are commercially available. During the final or "finishing" stage of treatment, either a soft wire is used for settling and minor adjustments of teeth, or a very stiff wire is used for locking the teeth in their intended ideal position, depending on the specific treatment. Soft stainless steel such as braided wires or very hard stainless steels or other alloys such as Co/Cr based alloys are generally used in these contexts, respectively.

Beta phase titanium alloys provide many of the desired characteristics required during the second stage of treatment, including intermediate stiffness, working range and bendability. On the other hand, NiTi based alloys exhibit an improved working range vis-a-vis beta phase titanium alloys, however, they have relatively low stiffness.

What are needed are dental and orthodontic articles, including adhesives, comprised of alloys which possesses a broad range of the properties desired in orthodontic treatments, extending through the initial, intermediate and final stages of treatment.

SUMMARY OF THE INVENTION

In its broadest aspects, the present invention is directed to dental and orthodontic articles which comprise an alloy having as a primary constituent at least one element selected from the group consisting of Ti, Zr, Si, Mo, Co, Nb and Be. The alloy may further include at least one secondary alloying element selected from the group consisting of Ta, Cr, Al, V, Pd, Hf and Fe. Alloys made from these materials, which are reactive elements, possess unique properties, including improved flexibility, combined with moderate stiffness. The combination of increased flexibility and moderate stiffness is believed to be highly desirable for dental and orthodontic articles such as orthodontic wires, springs, brackets and endodontic and dental files or reamers.

In a preferred embodiment, a dental or orthodontic article comprised of an alloy of reactive metals has a modulus of elasticity in the range of about 5 million to 15 million psi and has a maximum average grain size of about 100 microns. Even more preferably, the primary constituent of the alloy is titanium or zirconium, and it is also preferred that the primary constituents are a combination of titanium and zirconium. Alloys and the articles produced therefrom, are biocompatible, and the alloys exhibit at least partial superelastic and shape memory characteristics.

In order to achieve the desired stiffness levels, it is believed that the alloys of this invention require a significant amount of cold work when formed into a wire shape. This will also affect the grain size which can have a significant impact on the material properties, particularly wires wherein finer grain structures tend to produce greater flexibility and fatigue resistance. Furthermore grain size becomes particularly important when the material exhibits any degree of shape memory and/or superelastic behavior.

These and other features of the present invention will become apparent to persons skilled in the art upon reading the following detailed description.

DETAILED DESCRIPTION OF THE INVENTION

Alloys according to the present invention advantageously possess reduced flexural modulus vis-a-vis the known stainless steel compositions which are typically used in orthodontic and dental articles. Additionally, the percent recovery of the alloys of the present invention far exceed those of stainless steels. A comparison of alloys of the present invention (last two) vis-a-vis known stainless steels (first two) are provided in Table 1 below.

| Composition | Flexural Modulus $\times 10^6$ psi | Recovery % | U.T.S. (ksi) | Comments |
|---|---|---|---|---|
| Cr - 18%<br>Ni - 10% | 25 | 17 | 320 | Stnlss<br>Steel |

-continued

| Composition | Flexural Modulus $\times 10^6$ psi | Recovery % | U.T.S. (ksi) | Comments |
|---|---|---|---|---|
| Fe - bal.<br>Cr - 16%<br>Ni - 4%<br>Cu - 4%<br>Nb - 0.3% | 31 | 15 | 150 | Stnlss Steel |
| Fe - bal.<br>Ni - 48%<br>Fe - 2%<br>Ti - bal. | ~6 | ≧70 | 220 | Pseudo-elastic |
| Mo - 15%<br>Zr - 5%<br>Al - 3%<br>Ti - bal. | ~10 | ≧40 | 190 | titanium based |
| Nb - 45%<br>Ti - bal. | ~6 | 17 | 150 | titanium based |

These demonstrated properties of improved flexibility and moderate stiffness facilitate use of the alloys of the present invention in various orthodontic appliances, and particularly orthodontic archwires.

The invention encompasses alloys and dental or orthodontic articles made therefrom which have as a primary constituent at least one element selected from the group consisting of Ti, Zr, Si, Mo, Co, Nb and Be. Preferably, the primary constituent(s) comprise(s) in the range of about 30–85% by weight of the alloy. Additionally, the alloys preferably comprise at least one secondary alloying element selected from the group consisting of Ta, Cr, Al, V, Pd, Hf, and Fe. The secondary alloying element is/are preferably present in the range of about 0.5–10% by weight, and more preferably in the range of about 1.0–10% by weight of the alloy.

In a specific alternative example of the present invention, an alloy of 45% wt Nb, balance Ti may advantageously be used for an orthodontic or dental article such as an archwire. An archwire of this composition has a modulus of elasticity of about 6,000,000 psi and has a working range of about 17%, which is approximately the same as the working range of some stainless steels. Furthermore, a wire of such composition is believed to be easily bent, yet will spring back to the same extent as stainless steels, and thus is believed to be well suited for orthodontic "finishing" applications. This suitability stems from the fact that only small forces are required in orthodontic finishing applications and that a large working range is not highly Important. Additionally, a wire of this composition is susceptible to fine "adjustments;" i.e., a permanent set such as may be imparted by a sharp bend with pliers. The relatively high ductility of the wire of this composition allows it to be bent a great deal without breaking.

While the invention has been described with reference to specific examples and embodiments, the scope of the present invention is not to be so limited and is to be construed in accordance with the appended claims.

What is claimed is:

1. A dental or orthodontic article comprising an alloy having as a primary constituent at least one element selected from the group consisting of Ti, Zr, Si, Mo, Co, Nb, and Be, and at least one secondary alloying element selected from the group consisting of Ta, Cr, Al, V, Pd, Hf, and Fe, said alloy having a modulus of elasticity in the range of about 5 million to 15 million psi and a maximum average grain size of about 100 microns, and said alloy being substantially free of Ni, said article selected from the group consisting of orthodontic archwires, springs, brackets and endodontic files and reamers.

2. A dental or orthodontic article according to claim 1 wherein said primary constituent is Ti.

3. A deal or orthodontic article according to claim 1 wherein said primary constituent is Zr.

4. A dental or orthodontic article according to claim 1 wherein said primary constituents are Ti and Zr.

5. A dental or orthodontic article according to claim 1 wherein said alloy is biocompatible.

6. A dental or orthodontic article according to claim 1 wherein said alloy exhibits at least partial superelastic and shape memory characteristics.

7. A dental or orthodontic article according to claim 1 wherein said secondary alloying element is present in the range of about 0.5–10% by weight of said alloy.

8. A dental or orthodontic article according to claim 7 wherein said secondary alloying element is present in the range of about 1.0–10% by weight of said alloy.

* * * * *

UNITED STATES PATENT AND TRADEMARK OFFICE

CERTIFICATE OF CORRECTION

PATENT NO. : 6,273,714 B1
DATED : August 14, 2001
INVENTOR(S) : Farrokh Farzin-Nia et al.

It is certified that error appears in the above-identified patent and that said Letters Patent is hereby corrected as shown below:

Title page,
ABSTRACT, line 2, "T" should be -- Ti --.

Column 4,
Line 28, "deal" should be -- dental --.

Signed and Sealed this

Twelfth Day of March, 2002

*Attest:*

*Attesting Officer*

JAMES E. ROGAN
*Director of the United States Patent and Trademark Office*